US006257445B1

(12) United States Patent
Means et al.

(10) Patent No.: US 6,257,445 B1
(45) Date of Patent: Jul. 10, 2001

(54) ELECTRICALLY OPERATED VISCOUS FLUID DISPENSING APPARATUS AND METHOD

(75) Inventors: Scott Means, Lawrenceville; Laurence B. Saidman, Duluth, both of GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/533,131

(22) Filed: Mar. 23, 2000

(51) Int. Cl.[7] ..... B67B 7/00
(52) U.S. Cl. ..... 222/1; 222/504
(58) Field of Search ..... 222/1, 504, 510, 222/518, 61, 333, 399; 251/129.02; 137/614.11

(56) References Cited

U.S. PATENT DOCUMENTS 3,811,601 5/1974 Reighard et al. .
4,678,100 7/1987 Gelinas et al. .
4,711,379 * 12/1987 Price ..... 222/504
4,842,162 * 6/1989 Merkel ..... 222/1
5,207,352 * 5/1993 Porter et al. ..... 222/1
5,875,922 * 3/1999 Chartine et al. ..... 222/1
5,915,591 * 6/1999 Erickson et al. ..... 222/1

* cited by examiner

*Primary Examiner*—Kevin Shaver
*Assistant Examiner*—M A Cartagena
(74) *Attorney, Agent, or Firm*—Wood, Herron & Evans, L.L.P.

(57) ABSTRACT

A fluid dispensing apparatus for dispensing a viscous fluid from a source of viscous fluid onto a substrate. The dispensing apparatus includes an electrically operated, normally-opened, dispensing valve having an inlet in fluid communication with the source of fluid and a shut-off valve fluidly connected between the inlet of the dispensing valve and the source of viscous fluid. The shut-off valve has a normally-closed state interrupting fluid communication between the source of fluid and the inlet of the dispenser body, thereby inhibiting the normally-opened dispensing valve from dispensing fluid when power is removed from the dispensing apparatus.

14 Claims, 4 Drawing Sheets

ELECTRICALLY OPERATED VISCOUS FLUID DISPENSING APPARATUS AND METHOD

FIELD OF THE INVENTION

The present invention generally relates to an apparatus for dispensing viscous fluids and more specifically, to an electrically operated apparatus for dispensing viscous liquids, such as hot melt adhesives.

BACKGROUND OF THE INVENTION

Various viscous fluid dispensers have been developed for the precise placement of viscous fluid such as a hot melt adhesive. Generally, viscous fluid dispensers have a valve stem with a valve body on its distal end which is disposed on an upstream side of a valve seat and moved in an upstream direction to open the valve and in a downstream direction to close the valve. For purposes of this document, the term "upstream" refers to a direction or location that is toward or closer to the source or fluid inlet and away or further from the fluid outlet of the dispenser; and "downstream" refers to a direction or location that is toward or closer to a fluid outlet and away or further from a source or fluid inlet of the dispenser. Many viscous fluid dispensing applications require that the viscous fluid be applied to the substrate with sharply defined boundaries, that is, the leading and trailing edges of the applied pattern of fluid on the substrate fluid be sharply defined or delimited. Thus, it is necessary that the motion of the valve body be very fast, and the flow of viscous fluid be abruptly started and stopped. With the valve construction described above, when the valve opens, the valve body is moving in an upstream direction against the direction of flow of the fluid and has a tendency to delay and disrupt the flow of fluid out of the dispensing nozzle. Similarly, when the valve closes, the valve body is moving in the downstream direction with the direction of fluid flow and has a tendency to cause a small additional quantity of fluid to be dispensed.

To provide a sharper initiation and cut-off of fluid flow, a "snuff back" valve construction is known. With this construction, the valve body is disposed on a downstream side of a valve seat and moved in the downstream direction away from the valve seat to open the valve and in the upstream direction toward the valve seat to close the valve. Consequently, as the valve opens, the valve body is moving in the same downstream direction as the viscous fluid; and the viscous fluid begins to be dispensed simultaneously with the opening of the valve body. When the valve closes, the valve body is moving in the upstream direction and is effective to sharply cut-off the flow of viscous fluid. While such valves are operated by electric-pneumatic solenoids, due to the relatively short useful life of pneumatic solenoids and their inability to be precisely and repeatably controlled over the long term, it is desirable to provide an electrically operated viscous fluid dispenser of the above-described "snuff-back" design.

Such "snuff-back" electric fluid dispensers are known and are generally of the structure illustrated in FIG. 4. An electrically operated viscous fluid dispenser or dispensing gun 20 comprises one or more dispensing modules or valves 22 mounted on a fluid distribution manifold plate 24 in a known manner. The dispensing valve 22 includes a dispenser body 26 and a fluid dispensing nozzle body 28 having a nozzle 30 through which droplets 32 of the viscous fluid are dispensed onto a substrate 34. Relative motion between the substrate 34 and dispenser 20 is provided in a known manner.

A valve stem 36 is mounted within the dispenser body 26 and has a valve body 38 on its lower, distal end below or downstream of a valve seat 40. The valve body 38 sealingly engages with a valve seat 40 to inhibit the flow of fluid from the dispenser 20. A fluid inlet passageway 42 intersects the interior portion 44 of the dispenser body 26 and is connected to a fluid passage 46 in the manifold 24 which, in turn, is fluidly connected to a pressurized source of viscous fluid 48, such as a hot melt adhesive. Arrows 49 indicate the flow path of the fluid entering through the fluid inlet passageway 46 and through the interior portion 44.

An armature 50 is disposed within the interior portion 44 and is coaxially aligned with, and is often formed integrally with, a proximal end of the valve stem 36. An electromagnetic coil 52 is disposed about the armature 50. A return spring 54 biases the valve stem 36 and valve body 38 in an upstream, upward direction to a closed position at which the valve body 38 sealingly contacts the valve seat 40, thereby interrupting the flow of viscous fluid through the nozzle 30. The return spring 54 is normally a compression spring which is placed under compression within the bore 60 through engagement with an electromagnetic pole 56. When supplied with electrical current, the coil 52 generates an electromagnetic field. The electromagnetic coil 52 must generate an electromagnetic field between the armature 50 and the pole 56 of sufficient strength so as to attract the armature 52 and the pole 56 together. Since the pole 56 cannot move, the armature 52 moves downward against the force of the spring 54, thereby moving the valve body 38 downstream away from the valve seat 40 to its open position.

The design of the dispensing valve 22 of FIG. 4 is known as a normally-closed design for the reason that when the coil 52 is de-energized, the spring 54 maintains the valve body 38 sealingly against the valve seat 40, thereby holding the valve 22 in the closed position. Thus, the valve 22 is normally in, or defaults to, a closed state or position. Therefore, in the event of any electrical power failure to the coil 52, the valve 22 is always mechanically biased to the illustrated closed position. Thus, the valve 22 always defaults to the closed position.

However, to provide that desired normally-closed capability, the armature 50 must be located within the interior 44 above the pole 56; and further, the valve stem 36 must extend through a bore 58 within the pole 56. Those structural features introduce several disadvantages in the operation of the valve. First, the bore 58 in the pole 56 reduces the mass of the pole 56, thereby reducing the effectiveness and strength of the electromagnetic field produced by the coil 52 and pole 56, thereby reducing their capability to move the armature 50. Further, the viscous fluid presents a greater resistance to motion of the portion of the valve stem 36 located within the bore 58 than the portion of the valve stem 36 located outside the bore 58. In addition, the valve stem 36 is substantially elongated to be able to pass through the length of the pole 56, thereby increasing the mass that must be moved by the electromagnetic field. Therefore, the viscous fluid dispenser 20 of FIG. 4 requires that the coil 52 and pole 56 provide a greater electromagnetic force in order to move the armature 50, valve stem 36 and valve body 38 between the open and closed positions.

Second, the interior portion 44 extends over the entire length of the valve body 38, and there are wetted surfaces throughout the entire length of the interior portion 44 of the valve body 38. That large area of wetted surfaces increases the probability of the accumulation of char over the operating life of the dispenser 30. Char is a fluid residue that accumulates on wetted surfaces and is most generally caused by a long term degradation of the viscous fluid. To minimize the potential accumulation of char, the design of the valve of FIG. 2 has a further disadvantage of providing the viscous fluid inlet at the upper end of the dispenser body 26, thereby requiring the viscous fluid to pass through the entire length of the dispenser body 26 prior to being dispensed by the nozzle 30. That long and tortuous fluid flow path not only adds resistance to motion of the armature 50 and valve stem 36 in the viscous fluid, but in addition, the flow rate of the viscous fluid through the dispenser 20 may also be adversely impacted.

In the operation of an electric viscous fluid dispensing gun, the coupling between the coil and the armature is not efficient; and therefore, the electric coil of an electric dispensing valve normally is not capable of providing the same forces as a pneumatic solenoid. That fact in combination with the above described structural features in which the coil 52 and the pole 56 provide a weaker electromagnetic field and the armature 50, valve stem 36 and valve body 38 experience a greater resistance to motion, makes the valve construction of FIG. 4 unacceptable for many viscous fluid dispensing applications.

Therefore, there is a need to provide a more efficient and higher performance design for an electric dispensing gun of the "snuff-back" valve body design as described above.

SUMMARY OF INVENTION

The present invention provides an improved electric fluid dispenser for viscous fluids that is faster, more reliable and can be used in a wider range of fluid dispensing applications than known electrically operated viscous fluid dispensers. Further, the electrically operated fluid dispenser of the present invention is simpler in construction, less expensive to manufacture and has a longer useful life than known electrically operated viscous fluid dispensers.

In accordance with the principles of the present invention and the described embodiments, the invention in one embodiment provides a fluid dispensing apparatus for dispensing a viscous fluid from a source of viscous fluid onto a substrate. The dispensing apparatus includes an electrically operated, normally-opened, dispensing valve having an inlet in fluid communication with the source of fluid and a shut-off valve fluidly connected between the inlet of the dispensing valve and the source of viscous fluid. The shut-off valve has a normally-closed state interrupting fluid communication between the source of fluid and the inlet of the dispenser body. The shut-off valve is used to disconnect the dispensing valve from the source of viscous fluid when power is removed from the valves.

In one aspect of the invention, the dispensing valve has a valve body disposed downstream of a valve seat within a dispenser body. An armature is connected to the valve body, and an electrically operated coil is mounted adjacent the armature. The coil generates an electromagnetic field that moves the valve body into sealing contact against the valve seat, thereby preventing a flow of fluid from the dispensing valve. A biasing element biases the valve body in a downstream direction toward an open position; and in an absence of the electromagnetic field, the biasing element moves the valve body to an open position permitting the flow of viscous fluid from the dispensing apparatus.

In another aspect of the invention, a control provides a first signal to the dispensing valve to close the dispensing valve and a second signal to the shut-off valve to open the shut-off valve. In the absence of the first signal, the dispensing valve opens, and in the absence of the second signal, the shut-off valve closes. Thus, the dispensing valve is closed and opened by the control respectively applying and removing the first signal to the coil of the dispensing valve. The shut-off valve is opened by the second signal; however, if at any time power is removed from the control, the second signal is removed from the shut-off valve and the shut-off valve closes, thereby disconnecting the dispensing valve from the source of viscous fluid.

The electrically operated dispensing apparatus of the present invention has a substantially simpler structure that provides a stronger electromagnetic field and has less friction than known electric dispensing valves. Thus, the use of a normally-opened dispensing valve has the advantages of providing a more efficient, higher performance and higher quality fluid dispensing operation.

During a fluid dispensing cycle, the normally-opened dispensing valve is turned on and off at a frequency or rate that is appropriate for a particular application. In contrast, the shut-off valve is typically opened at the start of the fluid dispensing cycle and closed at the end of the fluid dispensing cycle. The shut-off valve is also closed in response to a user initiated or control initiated shut-down command. Thus, the shut-off valve is not required to be a high performance valve but instead, is a simple, inexpensive valve. Further, with its nominal performance requirements, the shut-off valve does not require a complex or expensive valve driver. Consequently, the addition of the simple shut-off valve and its valve driver in combination with the generally simpler structure of the normally-opened valve results in little, if any, additional cost to the dispensing apparatus.

The normally-opened valve of the present invention has a further advantage in those applications in which the valve, on average, is open more than it is closed. Energy is applied to the normally-opened valve only during the time that the valve is closed. Thus, heat dissipation in the normally-opened valve is limited and less than normally-closed valves, and the normally-opened valve has the advantage of being able to operate at a higher frequency without overheating. Therefore, the electrically operated dispensing valve of the present invention is simpler, less expensive and more reliable than known electric dispensing valves.

Various additional advantages, objects and features of the invention will become more readily apparent to those of ordinary skill in the art upon consideration of the following detailed description of embodiments taken in conjunction with the accompanying drawings.

DETAILED DESCRIPTION OF THE INVENTION

Figure 1:
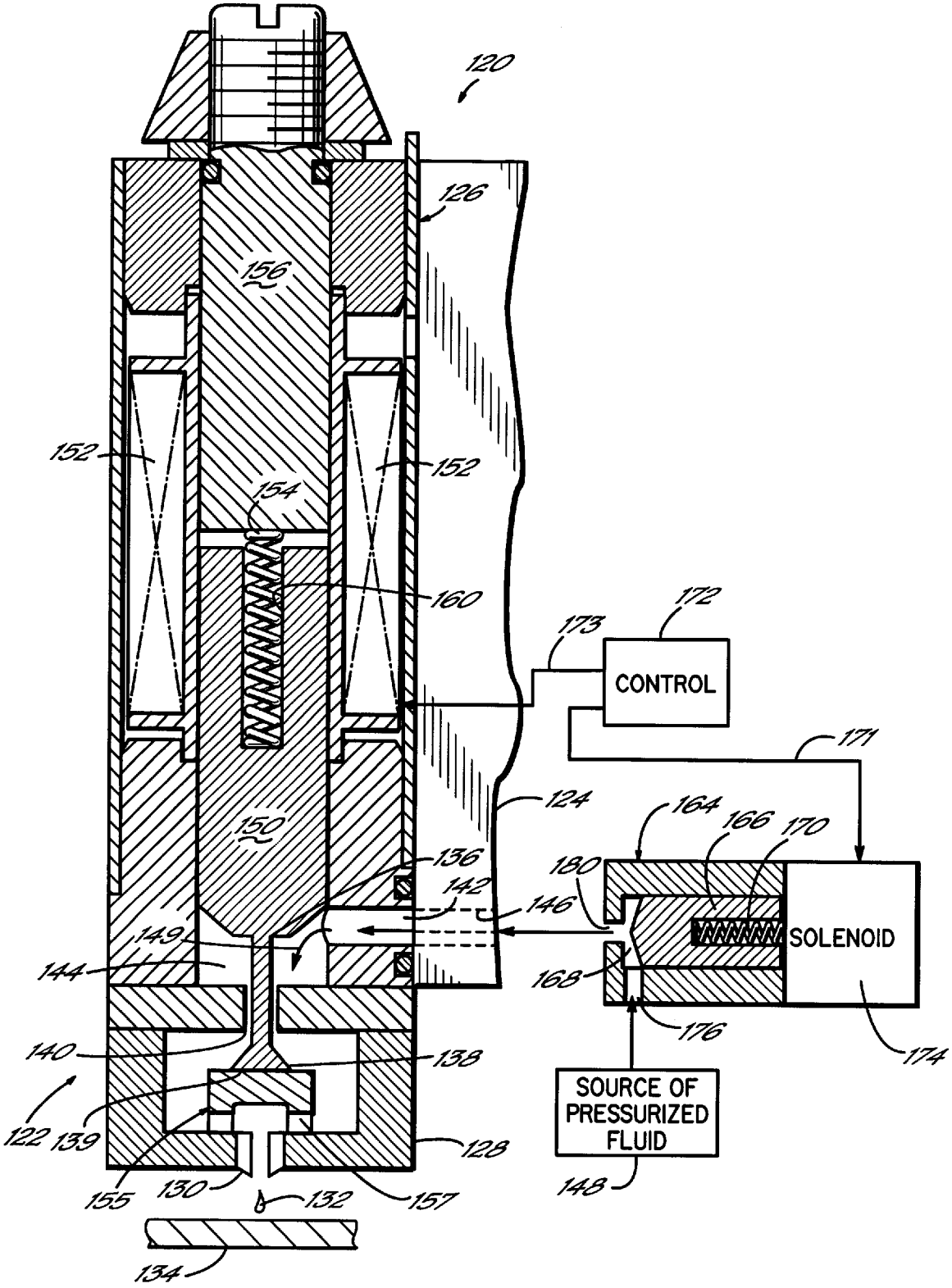
FIG. 1 is an axial cross-sectional view of an electrically operated fluid dispenser having a "snuff-back" valve body design in an opened position in accordance with the principles of the present invention.
Figure 2:
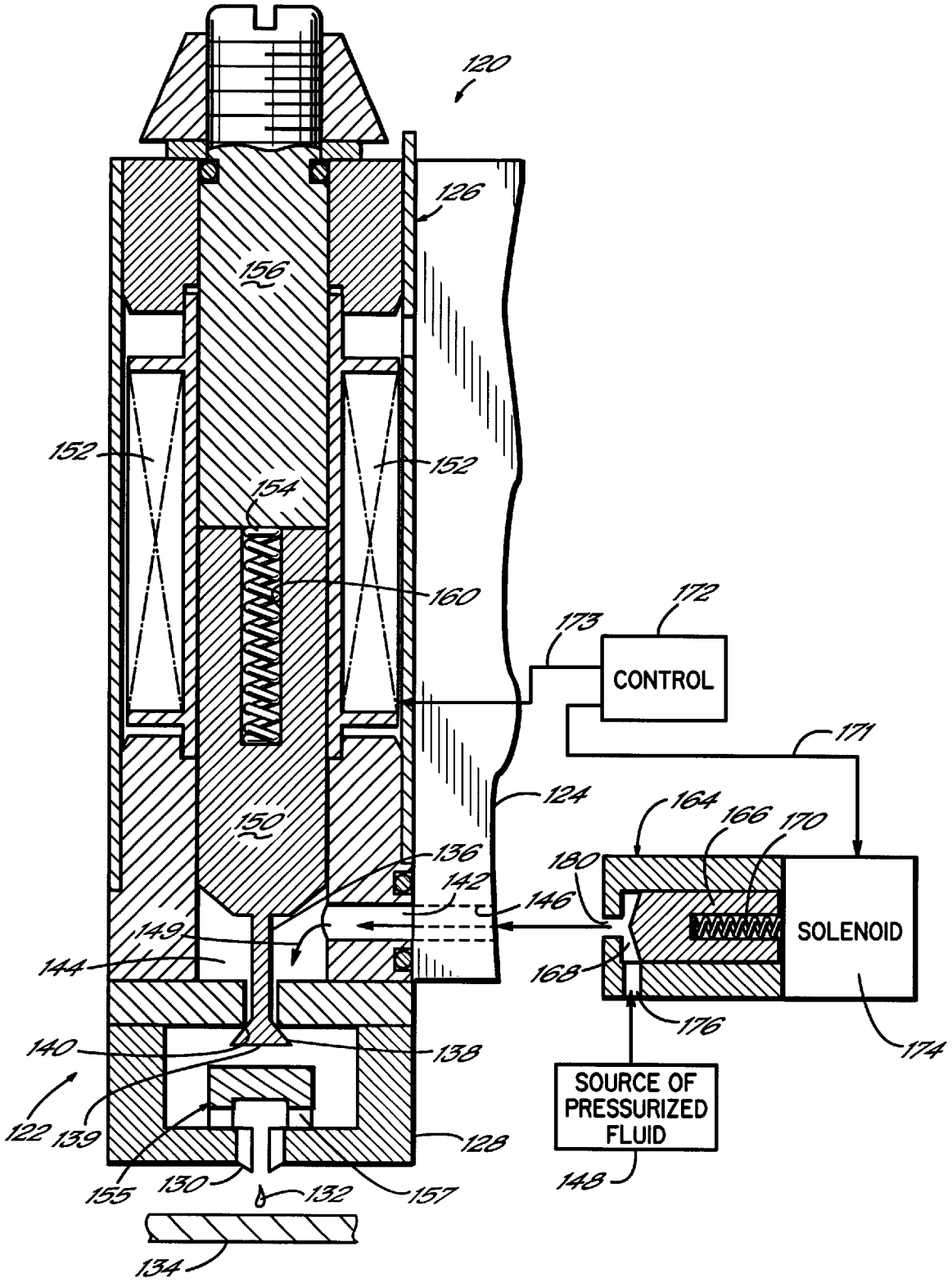
FIG. 2 is an axial cross-sectional view of the electrically operated fluid dispenser of FIG. 1 illustrating the "snuff-back" valve in a closed position.

Referring to FIG. 1, an electrically operated viscous fluid dispenser or dispensing gun 120 of the "snuff-back" design is illustrated which has generally similar components to the dispenser 20 of FIG. 2. The dispensing gun 120 of FIG. 1 comprises one or more dispensing modules or valves 122 mounted on a fluid distribution manifold plate 124. Each dispensing valve 122 includes a dispenser body 126 and a fluid dispensing nozzle body 128 with a nozzle 130 through which droplets 132 of the viscous fluid are dispensed onto a substrate 134. Relative motion between the substrate 134 and dispenser 120 is provided in a known manner.

A fluid inlet passageway 142 intersects the interior portion 144 of the dispenser body 126 and is connected to a fluid passage 146 in the manifold 124 which, in turn, is in fluid communication with a pressurized source of hot melt adhesive 148. Arrows 149 indicate the flow path of the fluid entering through the fluid inlet passageway 146 and through the interior portion 144 of the dispenser body 126. The dispenser 120 dispenses high viscosity fluids, such as a hot melt adhesive, but other dispensed fluids can benefit from the invention as well. Such other fluids include soldering fluxes, thermal greases, heat transfer compounds and solder pastes. Furthermore, the dispenser 120 is mounted in a dispensing machine or system (not shown) in a known manner to dispense fluids in discrete amounts, preferably as droplets or dots, but alternatively in continuous beads.

An armature 150 is disposed within the interior portion 144 and is coaxially aligned with, and is often formed integrally with, a valve stem 136. The valve stem 136 extends downward past the valve seat 140 and has a valve body 138 on its lower, distal end below or downstream of a valve seat 140. An electromagnetic coil 152 is disposed about the armature 150. A biasing element 154, for example, a spring, is disposed in a bore 160 within the valve stem 132. The biasing element 154 biases the valve stem 136 and valve body 138 in a downstream, downward direction away from the valve seat 140 to an open position as shown in FIG. 1, thereby opening the valve 122 and permitting the flow of viscous fluid through the nozzle 130. The biasing element 154 is often a compression spring which is placed under compression within the bore 160 by the armature 150. The downward stroke of the valve body 138 can be controlled one of several different ways. For example, a stop 155 is located in the lower interior portion of the nozzle body 128 and functions to limit the downward travel of the valve body 138. Thus, as the biasing element 154 pushes the valve toward an open position away from the valve seat 140, an end surface 139 strikes an upper portion of the stop 155; and the stop 155 supports the valve body 138 in the open position. The viscous fluid then flows from the source 148, past the valve seat 140 into the interior of the nozzle body 128, through openings 157 in the stop 155 and out the nozzle 130.

When supplied with electrical current, the coil 152 generates an electromagnetic field. The electromagnetic coil 152 must generate a sufficiently strong electromagnetic field between the armature 150 and the pole 156 so as to attract the armature 150 and the pole 156 together. Since the pole 156 cannot move, the armature 152 moves against the force of the biasing element 154, thereby moving the valve body 138 in an upward, upstream direction to a closed position as illustrated in FIG. 2 at which the valve body 138 sealingly contacts the valve seat 140, thereby interrupting the flow of viscous fluid through the nozzle 130.

Figure 3:
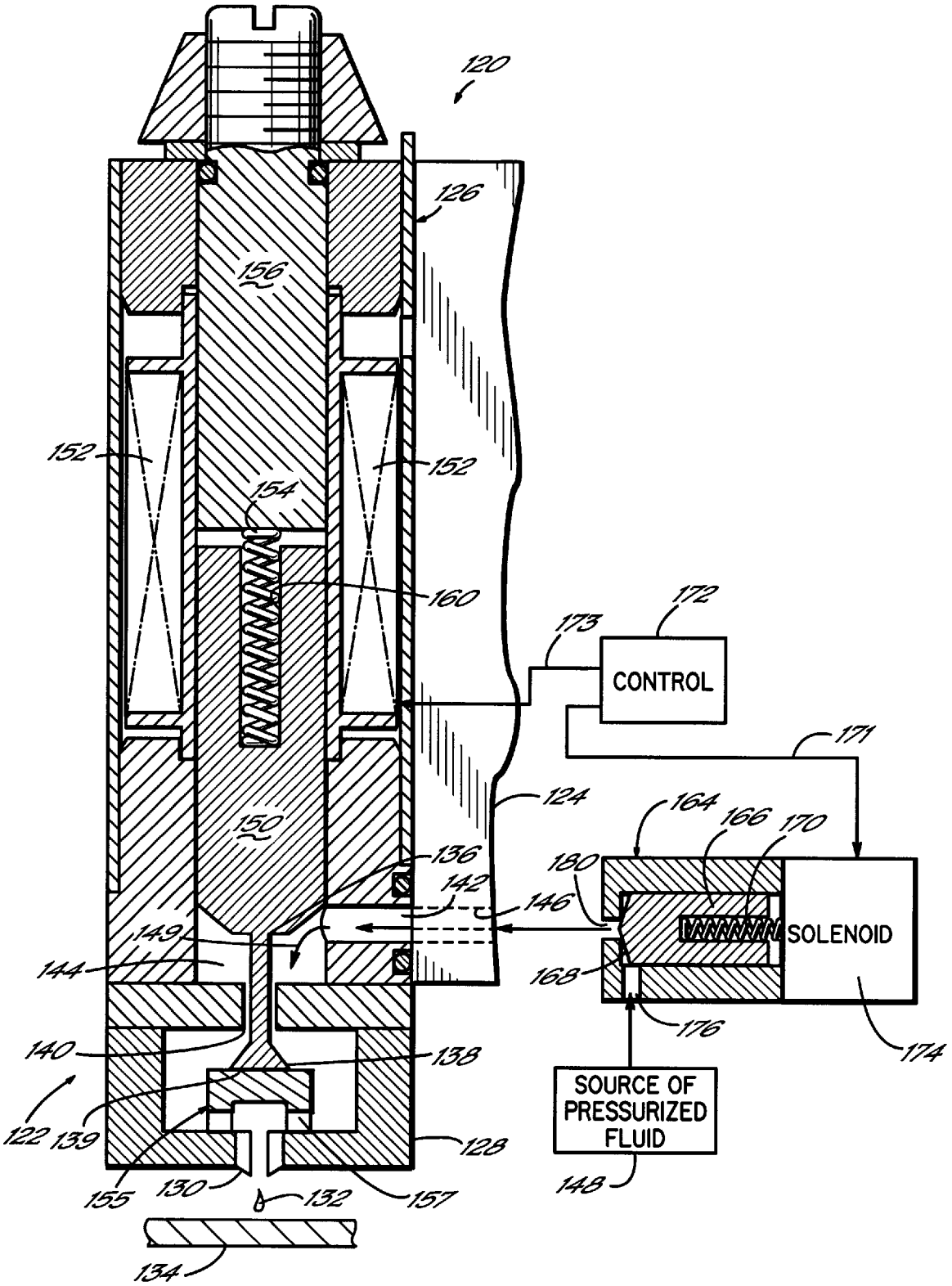
FIG. 3 is an axial cross-sectional view of the electrically operated fluid dispenser of FIG. 1 illustrating the "snuff-back" valve in the opened position and a check valve in a closed position.

The design of the dispensing valve 122 of FIGS. 1 and 2 is known as a normally-opened design for the reason that when the coil 152 is de-energized, the biasing element 154 functions to move the valve body 138 in a downstream direction out of contact with the valve seat 140, thereby opening the valve 122 as shown in FIG. 1. Thus, the valve 122 is normally in, or defaults to, an open state or position. Hence, in the event of any electrical failure, the valve 122 is mechanically biased to the open position and the viscous fluid is dispensed from the outlet nozzle 130. Obviously any uncommanded or inadvertent dispensing of the viscous fluid is undesirable. To avoid such a condition, a normally-closed shut-off valve 164 is placed in fluid communication between the normally-opened dispensing solenoid valve 122 and the source of viscous fluid 148. During normal operation of the normally-opened solenoid valve 122, power is a applied to the normally-closed shut-off valve 164, thereby maintaining the shut-off valve open. However, in the event of a loss of electrical power, as the dispensing valve 122 biases itself to the open position, the shut-off valve 164 is simultaneously biasing itself to its closed position, as shown in FIG. 3, thereby interrupting the flow of viscous liquid from the source 148 to the valve 122. The shut-off valve 164 is often a solenoid valve in which a valve element 166 is biased against a valve seat 168 by a biasing element or spring 170. Such a solenoid valve is commercially available as model no. E100AC from Slautterback Corporation of Monterey, Calif.

In use, whenever power is applied to a control 172, the control 172 provides a signal over output line 171 to energize a solenoid 174 of the normally-closed shut-off valve 164 causing the solenoid 174 to electromagnetically move the valve element 166 away from the valve seat 168 as shown in FIG. 1. When the valve element 166 moves away from the valve seat 168, fluid from the source of fluid 148 flows through an inlet passage 176, past the valve seat 168, through an outlet passage 180 and into the inlet passages 146, 142 of the manifold 124 and valve 122, respectively. Thus, with the shut-off valve 164 open, the dispensing valve 122 is fluidly connected to the source of fluid 148.

Upon power being applied to a control 172, the control 172 further provides a signal over output line 173 to apply power to, and energize, the magnetic coil 152. The electromagnetic field generated by the coil 152 secures the valve body 138 in sealing contact with the valve seat 140, as shown in FIG. 2, thereby maintaining the valve 122 closed. In the closed state, viscous fluid is not dispensed from the source of fluid 148 to the substrate 134 via the nozzle 130. When it is desired to dispense viscous fluid from the valve 122, the control 172 terminates the signal on output 171 to the coil 152, thereby causing the magnetic field to collapse. The biasing element 154 is then able to move the valve body 138 downward away from the valve seat 140 (FIG. 1), and the viscous fluid is dispensed from the source of fluid 148 and through the outlet 130 onto the substrate 132. Subsequently, when it is desired to terminate the viscous fluid dispensing operation, the control 172 again provides power to the coil 152, thereby energizing the coil 152 and creating an electromagnetic field that pulls the valve body 138 back into contact with the valve seat 140 (FIG. 2). That process continues in the process of dispensing fluid in a desired pattern onto the substrate. Thus, during a fluid dispensing cycle, the normally-opened dispensing valve 122 is turned on and off at a frequency or rate that is appropriate for a particular application.

Referring to FIG. 3, if at any time power is removed from the control 172, either predictably, by turning off the power, or unpredictably, through a system component failure, a tripped circuit breaker, accident, storm, etc., the signals on the output lines 171, 173 from the control 172 are terminated. Thus, power to the coil 152 is lost, and the electromagnetic field collapses, thereby permitting the biasing element 154 to move the valve body 138 to its open position (FIG. 1). Without the shut-off valve 164, fluid would immediately begin dispensing from the valve nozzle 130. Any such uncommanded and unintentional dispensing of viscous fluid is very undesirable; however, such is prevented by the operation of the shut-off valve 164. When power is lost to the control 172, the electrical signal from the control 172 to the shut-off valve 164 is also lost. Therefore, the electromagnetic field produced by the solenoid 174 within the shut-off valve 164 collapses; and the biasing element 170 moves the valve element 166 into sealing contact with the valve seat 180, thereby closing the shut-off valve 164. Thus, as the dispensing valve 122 is being biased to an open position by its biasing element 154, the valve element 166 within the shut-off valve 164 is simultaneously being biased to its closed position by its biasing element 170. The operation of the normally-closed valve 164 moving to its default closed position interrupts the flow of viscous fluid from the source of fluid 148 to the valve 122 and limits or eliminates any flow of viscous fluid from the nozzle 130.

Figure 4:
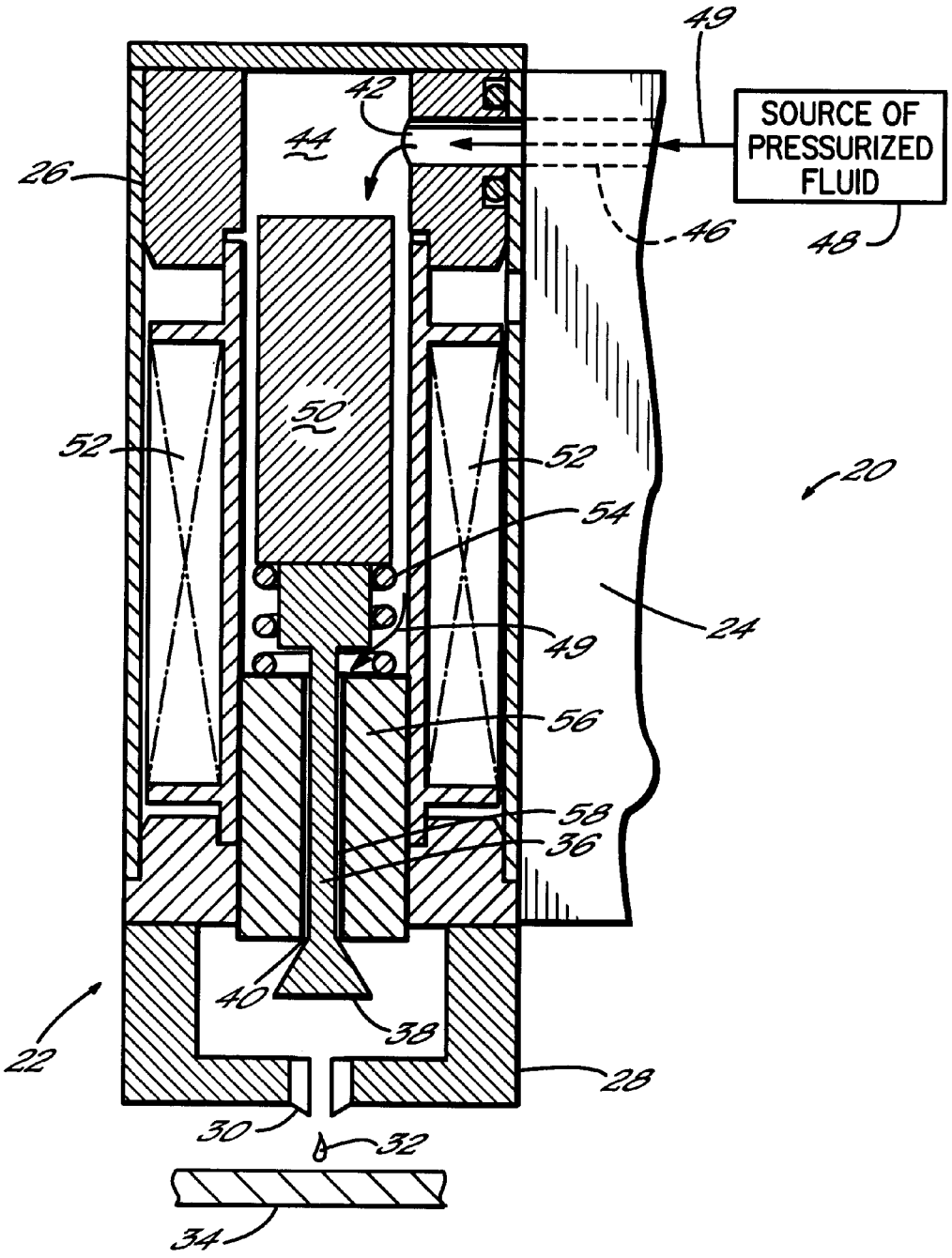
FIG. 4 PRIOR ART
FIG. 4 is an axial cross-sectional view of a known electrically operated fluid dispenser having a "snuff-back" body valve design.

The structure of the electric dispensing valve 122 of FIGS. 1–3 has many advantages over the design of the known electric dispensing valve shown in FIG. 2. First, the structure is substantially simpler in that the armature 150 is disposed below the pole 156. Such a construction permits the use of a larger pole, thereby increasing the strength of the electromagnetic field over the cored pole 56 of FIG. 4. The valve stem 136 and armature 150 of the dispensing valve 122 experience less friction from the viscous fluid than similar components in the design of FIG. 4. Further, with the dispensing valve 122 of FIGS. 1–3, the flow path of the viscous fluid within the dispensing valve 122 is shorter, thereby further reducing the frictional effect of the viscous fluid. In addition, with the dispensing valve 122 of FIGS. 1–3, there is less wetted area, and the formation of char is less likely. Finally, the mass of the valve stem 136 is less and requires less electromagnetic force to move than the dispensing valve stem 36 of FIG. 4. Thus, the use of a normally-opened dispensing valve has the advantages of providing a more efficient, higher performance and higher quality fluid dispensing operation.

In contrast to the higher performance, normally-opened valve 122, the shut-off valve 164 is typically opened at the start of the fluid dispensing cycle and closed at the end of the fluid dispensing cycle or in response to a user or control initiated shut-down command. Thus, the shut-off valve is a simple, inexpensive valve. Further, with its nominal performance requirements, the shut-off valve does not require a complex or expensive valve driver. Consequently, the addition of the simple shut-off valve and valve driver in combination with the generally simpler structure of the normally-opened valve results in little, if any, additional cost to the dispensing apparatus.

The normally-opened valve of the present invention has a further advantage in those applications in which the valve, on average, is open more than it is closed. Energy is applied to the normally-opened valve only during the time that the valve is closed. Thus, heat dissipation in the normally-opened valve is limited and less than normally-closed valves, and the normally-opened valve has the advantage of being able to operate at a higher frequency without overheating. Therefore, the electrically operated dispensing valve of the present invention is simpler, less expensive and more reliable than known electric dispensing valves.

While the present invention has been illustrated by a description of various embodiments and while these embodiments have been described in considerable detail in order to describe a mode of practicing the invention, it is not the intention of Applicant to restrict or in any way limit the scope of the appended claims to such detail. Additional advantages and modifications within the spirit and scope of the invention will readily appear to those skilled in the art. For example, the shut-off valve 164 is shown as a normally-closed valve located between the manifold 124 and the source of fluid 148. As will be appreciated, the shut-off valve 164 can be located anywhere that permits it to perform its shut-off operation. For example, the shut-off valve 164 may alternatively be built into the valve 122, the manifold 124 or the source of fluid 148.

Further, while the shut-off valve 164 is shown and described as an electric solenoid valve, a pneumatically actuated valve may alternatively be used. In fact, any valve may be used that provides a normally-closed valve action in the event that electrical power to the system is turned off or lost. In addition, the relative orientation of the shut-off valve 164 can be reversed over that shown in FIGS. 1–3, so that the passage 180 is an inlet connected to the source of fluid 148 and the passage 176 is an outlet connected to the passage 146.

Therefore, the invention in its broadest aspects is not limited to the specific detail shown and described. Consequently, departures may be made from the details described herein without departing from the spirit and scope of the claims which follow.

What is claimed is:

1. A fluid dispensing apparatus for receiving a viscous fluid from a source and dispensing the viscous fluid onto a substrate comprising:

an electrically operated, normally-opened dispensing valve having an inlet for receiving the viscous fluid and an outlet for dispensing the viscous fluid onto a substrate; and a shut-off valve fluidly connected between said inlet of said dispensing valve and the source of viscous fluid, said shut-off valve having a normally-closed state interrupting fluid communication between the source of the viscous fluid and said inlet of said dispensing valve.

2. The fluid dispensing apparatus of claim 1 wherein said dispensing valve comprises:

a dispenser body having a valve seat;

a valve body positioned downstream of said valve seat;

an armature connected to said valve body;

an electrically operated coil mounted adjacent said armature and generating an electromagnetic field capable of moving said valve body into sealing contact against said valve seat, thereby preventing a flow of fluid from said outlet; and a biasing element for biasing said valve body to an open position in an absence of the electromagnetic field, thereby permitting the flow of viscous fluid from the dispensing apparatus.

3. The fluid dispensing apparatus of claim 2 wherein said shut-off valve comprises:

a body having a valve seat, an inlet for receiving the viscous fluid from the source and an outlet in fluid communication with said inlet of said dispensing valve;

a valve stem positioned upstream of said valve seat;

an electrically operated coil mounted adjacent said valve stem and generating an electromagnetic field capable of moving said valve stem to an open position, thereby providing a flow of the viscous fluid from the source to said dispensing valve;

a biasing element for biasing said valve stem to a closed position in an absence of the electromagnetic field, thereby preventing a flow of the viscous fluid from said shut-off valve and said dispensing valve; and a control providing a first signal to said dispensing valve to close said dispensing valve, and a second signal to said shut-off valve to open said shut-off valve, wherein, in the absence of the first signal, said dispensing valve opens and, in the absence of the second signal, said shut-off valve closes.

4. The fluid dispensing apparatus of claim 1 wherein said shut-off valve comprises:

a body having a valve seat, an inlet for receiving the viscous fluid from the source and an outlet in fluid communication with said inlet of said dispensing valve;

a valve stem positioned upstream of said valve seat;

an electrically operated coil mounted adjacent said valve stem and generating an electromagnetic field capable of moving said valve stem to an open position, thereby providing a flow of the viscous fluid from the source to said dispensing valve; and a biasing element for biasing said valve stem to a closed position in an absence of the electromagnetic field, thereby preventing a flow of the viscous fluid from said shut-off valve and said dispensing valve.

5. The fluid dispensing apparatus of claim 4 further comprising a control providing a first signal to said dispensing valve to close said dispensing valve; and a second signal to said shut-off valve to open said shut-off valve, wherein, in the absence of the first signal, said dispensing valve opens and, in the absence of the second signal, said shut-of valve closes.

6. The fluid dispensing apparatus of claim 1 further comprising a control providing a first signal to said dispensing valve to close said dispensing valve; and a second signal to said shut-off valve to open said shut-off valve, wherein, in the absence of the first signal, said dispensing valve opens and, in the absence of the second signal, said shut-off valve closes.

7. A fluid dispensing apparatus for receiving a viscous fluid from a source and dispensing the viscous fluid onto a substrate comprising:

a dispenser body having a valve seat, an inlet for receiving the viscous fluid and an outlet for dispensing the viscous fluid onto a substrate;

a valve body positioned downstream of said valve seat;

an armature connected to said valve body;

an electrically operated coil mounted adjacent said armature and generating an electromagnetic field capable of moving said valve body in an upstream direction into sealing contact against said valve seat, thereby preventing a flow of fluid from said outlet;

a biasing element for biasing said valve body in a downstream direction to an open position in an absence of the electromagnetic field, thereby permitting the flow of the viscous fluid from the dispensing apparatus; and a shut-off valve fluidly connected between said inlet of said dispenser body and the source of fluid, said shut-off valve having a normally-closed position interrupting fluid communication between the source of fluid and said inlet of said dispenser body.

8. A fluid dispensing apparatus for dispensing viscous fluid from a source of fluid onto a substrate comprising:

a dispenser body having a valve seat, an inlet in fluid communication with the source of fluid and an outlet downstream of said valve seat;

a valve stem disposed within said dispenser body and having a valve body on its distal end positioned downstream of said valve seat;

an armature disposed within said dispenser body and connected to a proximal end of said valve stem;

an electrically operated coil mounted adjacent said armature and generating an electromagnetic field capable of moving said armature and said valve stem in an upstream direction to a closed position in which said valve body is sealingly engaged against said valve seat, thereby preventing a flow of fluid from said outlet;

a biasing element disposed within said dispenser body for biasing said armature, valve stem and valve body in a downstream direction to an open position in an absence of the electromagnetic field, thereby permitting the flow of viscous fluid from said outlet; and an electrically operated shut-off valve fluidly connected between said inlet of said dispenser body and the source of fluid, said shut-off valve having a normally-closed state interrupting fluid communication between the source of the viscous fluid and said inlet of said dispenser body.

9. A method of operating a fluid dispensing apparatus to dispense a viscous fluid from a source onto a substrate comprising:

applying electric power to a normally-closed shut-off valve receiving the viscous fluid from the source to open said shut-off valve and provide a path for the viscous fluid through said shut-off valve;

removing electric power to a normally-opened dispensing valve receiving the viscous fluid from said shut-off valve to open said dispensing valve and dispense the viscous fluid onto the substrate; and closing said normally-closed shut-off valve in response to a loss of electric power to said dispensing valve, thereby interrupting a flow of the viscous fluid through said shut-off valve, through said dispensing valve and onto the substrate.

10. A method of operating a fluid dispensing apparatus receiving a viscous fluid from a source and dispensing the viscous fluid onto a substrate comprising:

providing a first signal to a normally-closed shut-off valve fluidly connected to the source, thereby causing said shut-off valve to open;

providing an electric signal to an electrically operated, normally-opened dispensing valve having an inlet receiving viscous fluid from said shut-off valve, thereby causing said normally-opened dispensing valve to close;

removing the electric signal from said normally-opened dispensing valve, thereby causing said normally-opened dispensing valve to open; and removing the first signal from said normally-closed shut-off valve, in response to a loss of electric power to said normally-opened dispensing valve, thereby causing said normally-closed dispensing valve to close.

11. A method of operating a fluid dispensing apparatus to dispense a viscous fluid from a source onto a substrate comprising:

opening a normally-closed shut-off valve having an input fluidly connected to the source in response to the application of a signal to said shut-off valve, thereby passing the viscous fluid to through said shut-off valve;

selectively opening and closing a normally-opened dispensing valve having an input fluidly connected to an output of said shut-off valve in response to the removal and application, respectively, of an electric signal to said dispensing valve, thereby selectively dispensing the viscous fluid onto the substrate when said dispensing valve is open;

closing said normally-closed shut-off valve in response to a loss of electric power to said dispensing valve, thereby terminating a flow of the viscous fluid through said shut-off valve and said dispensing valve.

12. The method of claim 11 further comprising:

moving a valve body located downstream of a valve seat within said normally-opened dispensing valve in a downstream direction to an open position in response to a removal of the electric signal from said dispensing valve; and moving said valve body in an upstream direction to a closed position in response to an application of the electric signal from the dispensing valve.

13. The method of claim 11 further comprising:

moving a valve stem located upstream of a valve seat within said normally-closed shut-off valve in an upstream direction to an open position in response to the application of the signal to said shut-off valve; and moving said valve stem in a downstream direction to a closed position in response to a removal of the signal from said shut-off valve.

14. The method of claim 11 further comprising opening said normally-closed shut-off valve in response to the application of a second electric signal to said shut-off valve.

* * * * *

UNITED STATES PATENT AND TRADEMARK OFFICE

CERTIFICATE OF CORRECTION

PATENT NO. : 6,257,445 B1
DATED : July 10, 2001
INVENTOR(S) : Means et al.

It is certified that error appears in the above-identified patent and that said Letters Patent is hereby corrected as shown below:

Column 6,
Line 11, delete "a".

Column 8,
Line 3, delete "Applicant", insert -- Applicants --.
Line 64, delete "an", insert -- a second --.

Column 9,
Line 2, after "the", insert -- second --.

Column 11,
Line 2, delete "to".

Signed and Sealed this

Twenty-first Day of May, 2002

*Attest:*

*Attesting Officer*

JAMES E. ROGAN
*Director of the United States Patent and Trademark Office*